US005624025A

United States Patent [19]

Hixon

[11] Patent Number: 5,624,025

[45] Date of Patent: Apr. 29, 1997

[54] MULTIPURPOSE TOILET TISSUE DISPENSER

[76] Inventor: Theodore Hixon, 209 Vine St., Roselle, N.J. 07203

[21] Appl. No.: 562,829

[22] Filed: Nov. 27, 1995

[51] Int. Cl.[6] ..... B65D 69/00

[52] U.S. Cl. ..... 206/233; 206/389; 362/253

[58] Field of Search ..... 206/214, 224, 206/233, 0.5, 389, 390, 397, 408; 239/60, 55, 56; 362/253, 96, 362; 248/497, 498; 312/242, 245

[56] References Cited

U.S. PATENT DOCUMENTS

| | | | |
|---|---|---|---|
| 3,304,034 | 2/1967 | Jones | 206/408 |
| 3,981,400 | 9/1976 | Quintana | 206/408 |
| 4,004,687 | 1/1977 | Boone | 206/233 |
| 4,223,965 | 9/1980 | Palandrani | 312/245 |
| 4,577,751 | 3/1986 | St-Jacques | 312/242 |
| 4,721,264 | 1/1988 | Muscarello | 206/390 |
| 4,957,246 | 9/1990 | Kantor | 206/233 |
| 4,978,095 | 12/1990 | Phillips | 206/233 |
| 5,006,966 | 4/1991 | Mikalonis | 362/362 |
| 5,163,549 | 11/1992 | Hayduchok | 206/214 |
| 5,236,168 | 8/1993 | Roy | 248/498 |
| 5,243,500 | 9/1993 | Stephenson et al. | 362/362 |
| 5,251,797 | 10/1993 | Martin | 362/253 |

*Primary Examiner*—Jimmy G. Foster
*Assistant Examiner*—Nhan Lam

[57] ABSTRACT

A multipurpose toilet tissue dispenser comprising: a housing having a front wall and including means for holding a roll of toilet paper; means for holding a night light assembly; a pencil holder; and means for holding an air freshener, the apparatus further including means for attaching the housing to a bathroom wall, the means for holding a roll of toilet paper including a generally semicylindrical shaped recess positioned in the front wall and a spindle for holding a roll of toilet paper, the spindle being releasably coupled within the recess, the spindle holding and permitting rotatable dispensing of toilet tissue when desired by a user.

10 Claims, 2 Drawing Sheets

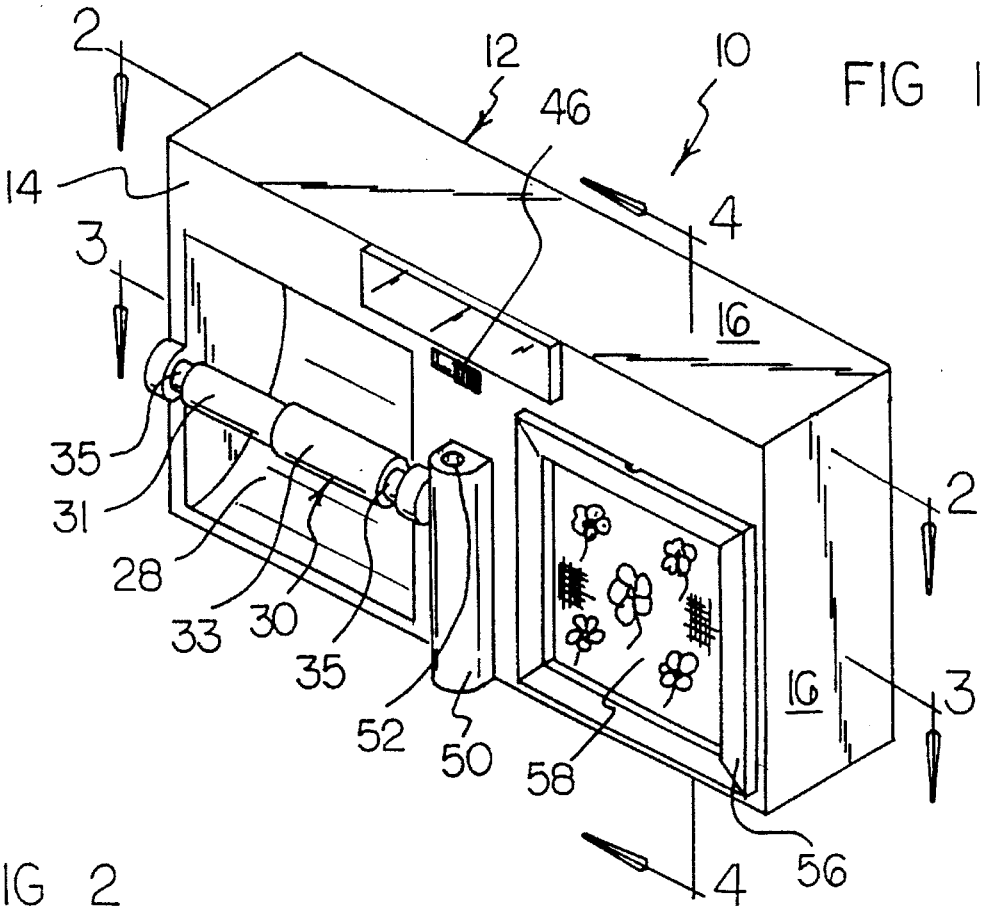
FIG 1
FIG 2
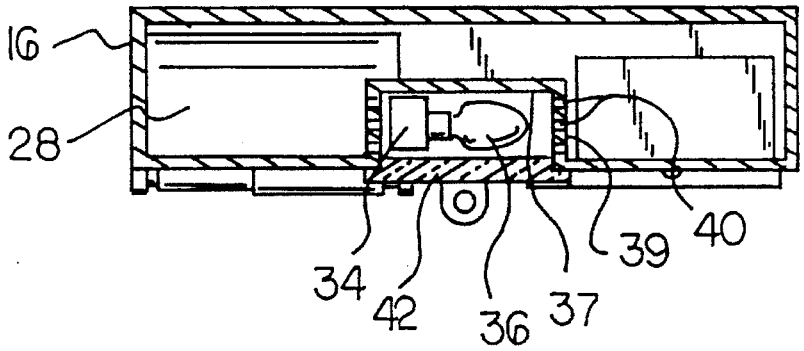
FIG 3
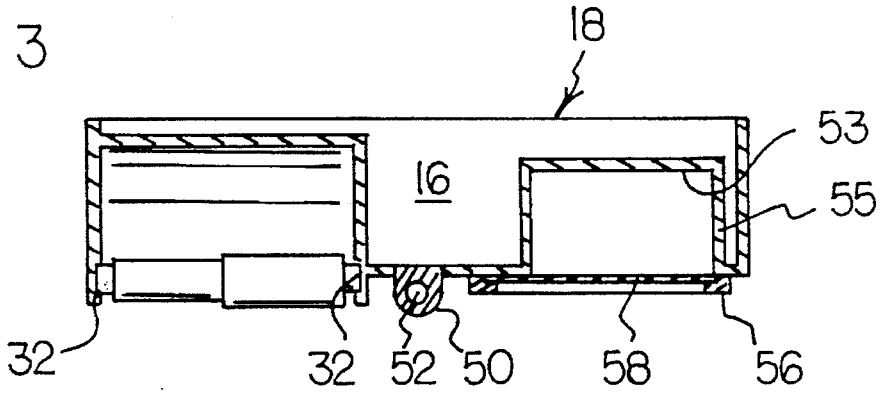

MULTIPURPOSE TOILET TISSUE DISPENSER

BACKGROUND OF THE INVENTION

1. Field of the Invention

The present invention relates to a multipurpose toilet tissue dispenser and more particularly pertains to providing users with an efficiently arranged combination of bathroom accessories.

2. Description of the Prior Art

The use of toilet paper holders is known in the prior art. More specifically, toilet paper holders heretofore devised and utilized for the purpose of holding and dispensing toilet paper are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 2,806,738 to Tsakalas a roll paper dispenser with built-in deodorant container.

U.S. Pat. No. 5,003,648 to Anderson discloses a light for toilet bowl.

U.S. Pat. No. 1,336,140 to Howard discloses a toilet paper holder.

Lastly, U.S. Pat. No. 4,825,779 to Simms discloses a table for toilet.

In this respect, the multipurpose toilet tissue dispenser according to the present invention substantially departs from the conventional concepts and designs of the prior art, and in doing so provides an apparatus primarily developed for the purpose of providing users with an efficiently arranged combination of bathroom accessories.

Therefore, it can be appreciated that there exists a continuing need for a new and improved multipurpose toilet tissue dispenser which can be used for providing users with an efficiently arranged combination of bathroom accessories. In this regard, the present invention substantially fulfills this need.

SUMMARY OF THE INVENTION

In view of the foregoing disadvantages inherent in the known types of toilet paper holders now present in the prior art, the present invention provides an improved multipurpose toilet tissue dispenser. As such, the general purpose of the present invention, which will be described subsequently in greater detail, is to provide a new and improved multipurpose toilet tissue dispenser and method which has all the advantages of the prior art and none of the disadvantages.

To attain this, the present invention essentially comprises a new and improved multipurpose toilet tissue dispenser comprising, in combination: a housing including a front wall, four side walls, and an essentially open back, the back having an upper extent with a hanger bar positioned thereacross, the hanger bar including two upwardly extending slots positioned therein, the back also having a lower extent including a centrally positioned tab extending therefrom, the tab including an aperture, the hanger bar and tab permitting attachment of the apparatus to a bathroom wall; a generally semicylindrical shaped recess being positioned in the front wall, the recess having a front edge including two centrally positioned semicircular projections, each projection including an indent, a spindle for holding a roll of toilet paper, the spindle including two end members, the spindle being releasably couplable within the within the projections with the end members rotatably positioned within the indents, the spindle holding and permitting rotatable dispensing of toilet tissue when desired by a user; a night light assembly including a cavity formed of a recessed rear wall, a plurality of side walls and an open front, the cavity being positioned within the housing, a light socket and light bulb being positioned in the cavity, a clear light transmitting cover releasably coupled over the open front of the cavity, the cavity being provided with vent openings to cool the night light, the housing including an on/off switch for operating the night light, an electrical lead wire having a first end including an electrical plug adapted to be coupled to a bathroom electrical outlet, the electrical lead wire having a second end operatively coupled to the on/off switch and light socket, the night light assembly permitting light to be transmitted from the apparatus when in use; a pencil holder formed in an elongated generally cylindrical configuration and affixed vertically to the front wall of the housing, the pencil holder having a closed bottom end and an open top end including a downwardly extending bore, the bore of the pencil holder permitting a pencil to be held therein; and an air-freshener holder formed in a box-like configuration and positioned within the housing, the air-freshener holder having a recessed rear wall, a plurality of side walls and an open front, the open front having an outer edge, a cover door being coupled to the outer edge by a hinge, the cover door comprising a frame and a diffusing cover, the diffusing cover being fabricated of a porous material thereby permitting scent to diffuse from the air-freshener through the diffusing cover.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multipurpose toilet tissue dispenser which has all of the advantages of the prior art toilet paper holders and none of the disadvantages.

It is another object of the present invention to provide a new and improved multipurpose toilet tissue dispenser which may be easily and efficiently manufactured and marketed.

It is further object of the present invention to provide a new and improved multipurpose toilet tissue dispenser which is of durable and reliable constructions.

An even further object of the present invention is to provide a new and improved multipurpose toilet tissue dispenser which is susceptible of a low cost of manufacture with regard to both materials and labor, and which accordingly is then susceptible of low prices of sale to the consuming public, thereby making such multipurpose toilet tissue dispenser economically available to the buying public.

Still yet another object of the present invention is to provide a new and improved multipurpose toilet tissue dispenser which provides in the apparatuses and methods of the prior art some of the advantages thereof, while simultaneously overcoming some of the disadvantages normally associated therewith.

Still another object of the present invention is to provide users with an efficiently arranged combination of bathroom accessories.

Lastly, it is an object of the present invention to provide a new and improved a multipurpose toilet tissue dispenser comprising: a housing including means for holding a roll of toilet paper; means for holding a night light assembly; a pencil holder; and means for holding an air freshener, the apparatus further including means for attaching the housing to a bathroom wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the multipurpose toilet tissue dispenser constructed in accordance with the principles of the present invention.

FIG. 2 is a cross sectional view taken along section line 2—2 of FIG. 1.

FIG. 3 is a cross sectional view taken along section line 3—3 of FIG. 1.

The same reference numerals refer to the same parts through the various Figures.

DESCRIPTION OF THE PREFERRED EMBODIMENT

Figure 4:
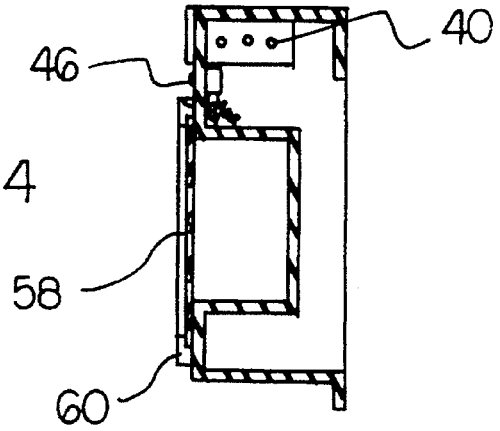
FIG. 4 is a cross sectional view taken along section line 4—4 of FIG. 1.

With reference now to the drawings, and in particular to FIG. 1 thereof, the preferred embodiment of the new and improved multipurpose toilet tissue dispenser embodying the principles and concepts of the present invention and generally designated by the reference numeral 10 will be described.

The present invention, the multipurpose toilet tissue dispenser 10 is comprised of a plurality of components. Such components in their broadest context include a housing 12, a semicylindrical shaped recess 28, a spindle 30, a pencil holder 50 and a diffusing cover 58. Such components are individually configured and correlated with respect to each other so as to attain the desired objective.

Figure 5:
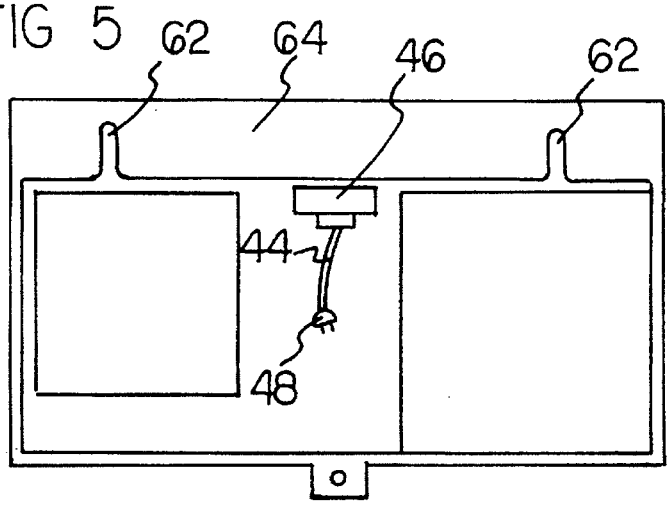
FIG. 5 is a rear perspective view of the preferred embodiment apparatus shown in FIG. 1.

More specifically, the housing 12 includes a front wall 14, four side walls 16, and an essentially open back 18. The back has an upper extent with a hanger bar 64 positioned across it. The hanger bar includes two upwardly extending slots 62 positioned within it. The back also has a lower extent which includes a centrally positioned tab 66 extending from it. The tab includes an aperture 68 extending through its approximate centerpoint. The hanger bar and tab permit attachment of the apparatus to a bathroom wall or some other supporting surface in an operative orientation. The slots are slidably coupled upon screws or nails when mounting the housing. The tab is coupled to a wall with a screw or nail. The apparatus may be located in a bathroom to be within easy reach of a user. Note FIG. 5.

A generally semicylindrical shaped recess 28 is positioned within the front wall. The recess is appropriately sized to accommodate a standard roll of toilet tissue. The recess has a front edge which includes two centrally positioned semicircular projections. Each projection includes an indent 32. A spindle 30 for holding a roll of toilet paper is included with the apparatus. The spindle includes a first cylindrical section 31 slidably positionable within a second cylindrical section 33. A biasing spring is positioned second cylindrical section. Each cylindrical section of the spindle includes an end member 35. The spindle is releasably couplable within the projections with the end members rotatably positioned within the indents. A roll of toilet tissue is held in place upon the spindle in an operative orientation. A roll of toilet paper may be placed upon the spindle in a conventional manner by compressing the biasing spring located in the spindle, removing the spindle from the indents in the projections, and placing the spindle through the center tube of a toilet tissue roll and then replacing the spindle in the indents. The spindle permits rotatable dispensing of toilet tissue when desired by a user. Note FIGS. 1 and 3.

A night light assembly includes a cavity formed of a recessed rear wall 37, a plurality of side walls 39 and an open front. The cavity is positioned within the housing. A light socket 34 and light bulb 36 are affixed to a sidewall within the cavity. A clear light transmitting cover 42 is releasably coupled over the open front of the cavity. The cover 42 is friction fit within the open front of the cover to permit replacement of a burned out light bulb. The clear cover allows light from the bulb to illuminate the front of the apparatus and the surrounding area of the bathroom. The night light assembly provides additional reading light for a user. Note FIGS. 1, 2 and 5.

The cavity is provided with vent openings 40 to cool the night light. Air flowing by convection past light bulb 36 will cool the night light. The housing includes an on/off switch 46 for operating the night light. The on/off switch 46 is conveniently positioned directly below the night light. An electrical lead wire 44 has a first end which includes an electrical plug 48. The electrical plug is adapted to be coupled to a bathroom electrical outlet. The electrical lead wire has a second end operatively coupled to the on/off switch and light socket. Note FIG. 1, 2 and 5.

Figure 6:
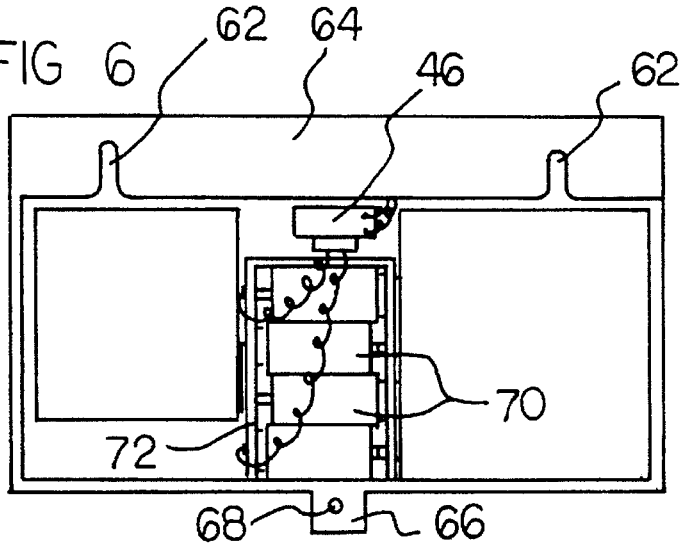
FIG. 6 is a rear perspective view of an alternative embodiment apparatus.

FIG. 6 illustrates an alternative embodiment of the apparatus. In such embodiment the night light is powered with batteries 70. A battery holder 72 is integrally connected to the inside of the housing 12 and is provided with conventional wiring connectors for connecting the batteries in series. To replace expended batteries the locking screw located through screw hole 68 is removed and the bathroom apparatus is removed from the wall. Note FIG. 6.

A pencil holder 50 is formed in an elongated generally cylindrical configuration and is affixed vertically to the front wall of the housing. The pencil holder has a closed bottom end and an open top end including a downwardly extending bore 52. The bore of the pencil holder permits a pencil to be held within it. A pencil holder in the bathroom is a very effective method of keeping a pencil available at all times. A readily available pencil makes it easy to jot down information to remember or work a crossword puzzle, etc. The light and pencil combination is especially useful when the existing light in a bathroom is insufficient for reading and writing. Note FIGS. 1 and 3.

An air-freshener holder is formed in a box-like configuration and is positioned within the housing. The air-freshener holder has a recessed rear wall 53, a plurality of side walls 55 and an open front. The open front has an outer edge. A cover door is coupled to the outer edge by a hinge 60. The cover door comprises a frame 56 and a diffusing cover 58. In the preferred embodiment the hinge is spring loaded. Such a spring will function to hold the diffusing cover tightly against the front wall 14 of the apparatus. When the user desires to replace or insert an air-freshener in the holder 54, the cover door may be opened by inserting a finger in the finger indent 63 located in the upper extent of the frame and pulling downwardly. The spring loaded hinge will automatically close the cover door. The diffusing cover is fabricated of a porous material thereby permitting scent to diffuse from the air-freshener through the diffusing cover and into the bathroom. The diffusing cover may be a porous material, such as cloth, or may be made with openings through which air may diffuse. Note FIGS. 1, 3 and 4.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new and improved multipurpose toilet tissue dispenser comprising, in combination:

a housing including a front wall, four side walls, and an essentially open back, the back having an upper extent with a hanger bar positioned thereacross, the hanger bar including two upwardly extending slots positioned therein, the back also having a lower extent including a centrally positioned tab extending therefrom, the tab including an aperture, the hanger bar and tab permitting attachment of the toilet tissue dispenser to a bathroom wall;

a generally semicylindrical shaped recess being positioned in the front wall, the recess having a front edge including two centrally positioned semicircular projections, each projection including an indent, a spindle for holding a roll of toilet paper, the spindle including two end members, the spindle being releasably couplable within the projections with the end members rotatably positioned within the indents, the spindle holding and permitting rotatable dispensing of toilet tissue when desired by a user;

a night light assembly including a cavity formed of a recessed rear wall, a plurality of side walls and an open front, the cavity being positioned within the housing, a light socket and light bulb being positioned in the cavity, a clear light transmitting cover releasably coupled over the open front of the cavity, the cavity being provided with vent openings to cool the night light, the housing including an on/off switch for operating the night light, an electrical lead wire having a first end including an electrical plug adapted to be coupled to a bathroom electrical outlet, the electrical lead wire having a second end operatively coupled to the on/off switch and light socket, the night light assembly permitting light to be emitted from the toilet tissue dispenser when in use;

a pencil holder formed in an elongated generally cylindrical configuration and affixed vertically to the front wall of the housing, the pencil holder having a closed bottom end and an open top end including a downwardly extending bore, the bore of the pencil holder permitting a pencil to be held therein; and an air-freshener holder formed in a box-like configuration and positioned within the housing, the air-freshener holder having a recessed rear wall, a plurality of side walls and an open front, the open front having an outer edge, a cover door being coupled to the outer edge by a hinge, the cover door comprising a frame and a diffusing cover, the diffusing cover being fabricated of a porous material thereby permitting scent to diffuse from the air-freshener through the diffusing cover.

2. A multipurpose toilet tissue dispenser comprising:

a housing including means for holding a roll of toilet paper; means for holding a night light assembly; a pencil holder; and means for holding an air freshener, the toilet tissue dispenser further including means for attaching the housing to a bathroom wall.

3. The multipurpose toilet tissue dispenser as set forth in claim 2 wherein a generally semicylindrical shaped recess is positioned in the front wall, a spindle for holding a roll of toilet paper being releasably coupled within the recess, the spindle holding and permitting rotatable dispensing of toilet tissue when desired by a user.

4. The multipurpose toilet tissue dispenser as set forth in claim 2 wherein the night light assembly includes a cavity formed of a recessed rear wall, a plurality of side walls and an open front, the cavity being positioned within the housing, a light socket and light bulb being positioned in the cavity, a clear light transmitting cover releasably coupled over the open front of the cavity, the night light assembly permitting light to be transmitted from the toilet tissue dispenser when in use.

5. The multipurpose toilet tissue dispenser as set forth in claim 4 wherein the housing includes an on/off switch for operating the night light, and the cavity of the night light assembly is provided with vent openings to cool the night light.

6. The multipurpose toilet tissue dispenser as set forth in claim 5 wherein an electrical lead wire has a first end including an electrical plug adapted to be coupled to a bathroom electrical outlet, the electrical lead wire having a second end operatively coupled to the on/off switch and light socket.

7. The multipurpose toilet tissue dispenser as set forth in claim 6 wherein the said housing includes a holder for a plurality of batteries, a plurality of batteries being positioned in the battery holder to provide electrical power to the night light through connecting wires to the on/off switch.

8. The multipurpose toilet tissue dispenser as set forth in claim 2 wherein the pencil holder is formed in an elongated generally cylindrical configuration and affixed vertically to the front wall of the housing, the pencil holder having a closed bottom end and an open top end including a downwardly extending bore, the bore of the pencil holder permitting a pencil to be held therein.

9. The multipurpose toilet tissue dispenser as set forth in claim 2 wherein the air-freshener holder is formed in a box-like configuration and positioned within the housing, the air-freshener holder having a recessed rear wall, a plurality of side walls and an open front, the open front having an outer edge, a cover door being coupled to the outer edge by a hinge, the cover door comprising a frame and a diffusing cover, the diffusing cover being fabricated of a porous material thereby permitting scent to diffuse from the air-freshener through the diffusing cover.

10. The multipurpose toilet tissue dispenser as set forth in claim 2 wherein the housing unit includes a front wall, four side walls, and an essentially open back, and the means for attaching the housing to a supporting wall are a hanger bar positioned across open back, and a tab extending from the back, the hanger bar including two upwardly extending slots positioned therein, the tab including an aperture, the hanger bar and tab permitting attachment of the toilet tissue dispenser to a bathroom wall.

* * * * *